US008048232B1

(12) United States Patent
Kusuura

(10) Patent No.: US 8,048,232 B1
(45) Date of Patent: Nov. 1, 2011

(54) CLEANING METHOD AND SYSTEM UTILIZING MICROCAPSULES

(75) Inventor: Takahisa Kusuura, Kanagawa (JP)

(73) Assignee: Empire Technology Development LLC, Wilmington, DE (US)

( * ) Notice: Subject to any disclaimer, the term of this patent is extended or adjusted under 35 U.S.C. 154(b) by 0 days.

(21) Appl. No.: 13/063,675

(22) PCT Filed: Nov. 8, 2010

(86) PCT No.: PCT/JP2010/070247

§ 371 (c)(1),
(2), (4) Date: Mar. 11, 2011

(51) Int. Cl.
*B08B 7/04* (2006.01)

(52) U.S. Cl. ..... 134/1; 8/137; 15/94; 137/201

(58) Field of Classification Search ..... 8/137; 15/94; 134/1, 201
See application file for complete search history.

(56) References Cited

U.S. PATENT DOCUMENTS

| | | | | |
|---|---|---|---|---|
| 6,080,687 | A | 6/2000 | Ishwarlal | |
| 6,551,576 | B1 | 4/2003 | Unger et al. | |
| 2003/0084916 | A1 * | 5/2003 | Gaaloul et al. | 134/1 |

FOREIGN PATENT DOCUMENTS

| | | | |
|---|---|---|---|
| JP | 10-140454 | A | 5/1998 |
| JP | 2003-171202 | A | 6/2003 |
| JP | 2007-63405 | A | 3/2007 |
| JP | 2007063405 | * | 3/2007 |
| WO | 2005004781 | A1 | 1/2005 |

OTHER PUBLICATIONS

International Search Report with Written Opinion issued Jan. 25, 2011 regarding PCT/JP2010/070247.
Tinkov, Steliyan, Development of Ultrasound Contract Agents for Targeted Drug and Gene Delivery, 2009, Ph.D. Dissertation, Ludwig-Maximilians University, Munich, Germany.
Ultrasonic Cleaning, Tech center seeks partner for the next phase, http:/www.natclo.com/views/fraunhofer.html—date retrieved Jun. 22, 2010.
Takagi, et al., Full Automatic Washing Machine with Ultra Sonic Spot Cleaner ES-U80C, Advertisement and specifications, Jan. 22, 2002. [Machine translation included].
Automated Cleaning Technology Increases Device Reliability for MEMS Industry, http://www.azonano.com/news.asp?newsID=6763—date retrieved Jun. 1, 2010.
http://www.tocho.com/choonpa2.htm—date retrieved Mar. 8, 2011 [machine translation included] [(c) 2000].
http://www.zenith-ultrasonics.com/what_is_ultrasonic_cavitation.htm—date retrieved Mar. 7, 2011 [(c) 2010].
http://www.elma-ultrasonic.jp/04-2.html dated Aug. 9, 2008 obtained from http://reply.waybackmachine.org/20080809043936/http://www.elma-ultrasonic.jp/04-2.html on Mar. 7, 2011 (machine translation included] [(c) 2006].
http://www.crestultrasonicsindia.com/Cleaning/CrestBenchtop.pdf••—date retrieved Mar. 7, 2011.
http://www.jikei.ac.jp/univ/gradu/rsch/06_14.html—date retrieved Mar. 7, 2011 [machine translation included] [(c) 2004].
http://www.hitachihyoron.com/2007/01/pdf/research.pdf—date retrieved Mar. 8, 2011 [machine translation included] [dated 2007].
http://www.hitachi.co.jp/New/cnews/month/2006/07/0714a.pdf—date retrieved Mar. 8, 2011 [machine translation included] [dated Jul. 14, 2006].
http://panasonic-denko.co.jp/corp/tech/report/541j/pdfs/541_17.pdf—date retrieved Mar. 7, 2011.
http://www.patentjp.com/06/F/F100014/DA10176.html—date retrieved Mar. 8, 2011 [machine translation included] [dated Aug. 9, 1994].
http://en.wikipedia.org/wiki/Surfactant—date retrieved Mar. 7, 2011.
http://www.j-tokkyo.com/2009/C11D/JP2009-249544.shtml—date retrieved Mar. 8, 2011 [machine translation included] [dated Oct. 29, 2009].
http://www.spc.co.jp/products/catalog/pdf/ug/sonichp05_a.pdf—date retrieved Mar. 8, 2011.
http://www.tdk.co.jp/techmag/ninja/daa00233.htm—date retrieved Mar. 8, 2011 [machine translation included].
http://www.nalex.co.jp/welder/principle.html—date retrieved Mar. 8, 2011 [machine translation included] [(c) 2003].
http://www.ndted.org/EducationResources/CommunityCollege/Ultrasonics/EquipmentTrans/piezotransducers.htm—date retrieved Mar. 8, 2011.
http://www.sankyoyushi.co.jp/seibun/main.html—date Mar. 13, 2005 obtained from http://reply.waybackmachine.org/20050313095353/http://www.sankyoyushi.co.jp/seibun/main.html on Mar. 8, 2011 (machine translation included] [(c) 2001].
http://liv.ed.ynu.ac.jp/kaisetsu/mecha03.pdf—date retrieved Mar. 8, 2011 [machine translation included] [dated Dec. 12, 2004].
http://www.kyowakisetsu.co.jp/Reading2.html—date retrieved Mar. 8, 2011 [machine translation included] [(c) 2007].
http://riverforestcorp.com/Micro-Nano%20Bubbles%20General%20and%20Possible%20Applications.pdf—date retrieved Mar. 7, 2011 [dated May 14, 2008].

* cited by examiner

*Primary Examiner* — Amina Khan
(74) *Attorney, Agent, or Firm* — Baker & Hostetler LLP

(57) ABSTRACT

A cleaning method uses a cleaning agent in which microcapsules are dispersed therein. Each of the microcapsules encapsulates a gas precursor, which is capable of undergoing a phase transition to a gas phase by application of ultrasonic wave energy. In the cleaning method, clothing to be cleaned is wetted with the cleaning agent, and then an ultrasonic wave is applied to the clothing to cause the microcapsules to expand and explode, releasing gas. Explosion energy of the microcapsules contribute to remove dirt stains from the clothing. In order to facilitate absorption of the cleaning agent, a smaller ultrasonic wave may be applied to the article before applying the ultrasonic wave for explosion.

23 Claims, 5 Drawing Sheets

CLEANING METHOD AND SYSTEM UTILIZING MICROCAPSULES

CROSS-REFERENCE TO RELATED APPLICATIONS

This application is a national stage entry of PCT/W2010/070247, filed Nov. 8, 2010, which is incorporated by reference.

BACKGROUND

Washing clothing in general requires sufficiently penetrating the water in which a laundry detergent is dissolved into the structure of fabric in order to remove dirt and stains on the fabric. In order to increase the penetration of water, a conventional washing machine typically agitates water containing a detergent as well as clothing in a laundry tub using an agitator or impeller, or tumbles the clothing submerged in water in a laundry drum.

Further, some attempts have been made to adapt an ultrasonic cleaning technique for washing clothing. A washing machine utilizing an ultrasonic cleaning technique generates an ultrasonic wave in the water containing a detergent in a laundry tub to induce ultrasonic cavitation. The ultrasonic cavitation is known to create in a moment vacuum bubbles in a liquid which immediately and violently implode to produce millions of microscopic jets of fluid. Fabric of clothing submerged in water in a laundry tub is attacked by the implosions, thereby allowing dirt and stains to be removed from the fabric. The ultrasonic cavitation is generated at anti-nodes of an ultrasonic wave in the form of a standing wave. Since the implosion energy of the ultrasonic cavitation is too high for the fabric, the ultrasonic cavitation not only causes the dirt and stains on the fabric to be removed therefrom but also causes the fabric to be eroded, which is referred to as the cavitation erosion. In order to protect the fabric against the cavitation erosion, the ultrasonic standing wave may be swept so that the ultrasonic cavitation does not continuously occur at the same points.

In addition, in a circumstance where a bunch of clothing is jumbled up in a laundry tub, a standing wave field is difficult to be created, and thus the ultrasonic cavitation cannot be stably generated within the structure of the fabric, resulting in insufficient cleaning action.

DETAILED DESCRIPTION

Reference will now be made in detail to embodiments, examples of which are illustrated in the accompanying drawings. The drawings are intended to be explanatory and may not be drawn to scale. In the following detailed description, numerous specific details are set forth in order to provide a thorough understanding of the present invention. However, it will be apparent to one of ordinary skill in the art that the present disclosure may be practiced without these specific details. In other instances, well-known methods, procedures, components, and circuits have not been described in detail so as not to unnecessarily obscure aspects of the embodiments.

Figure 1:
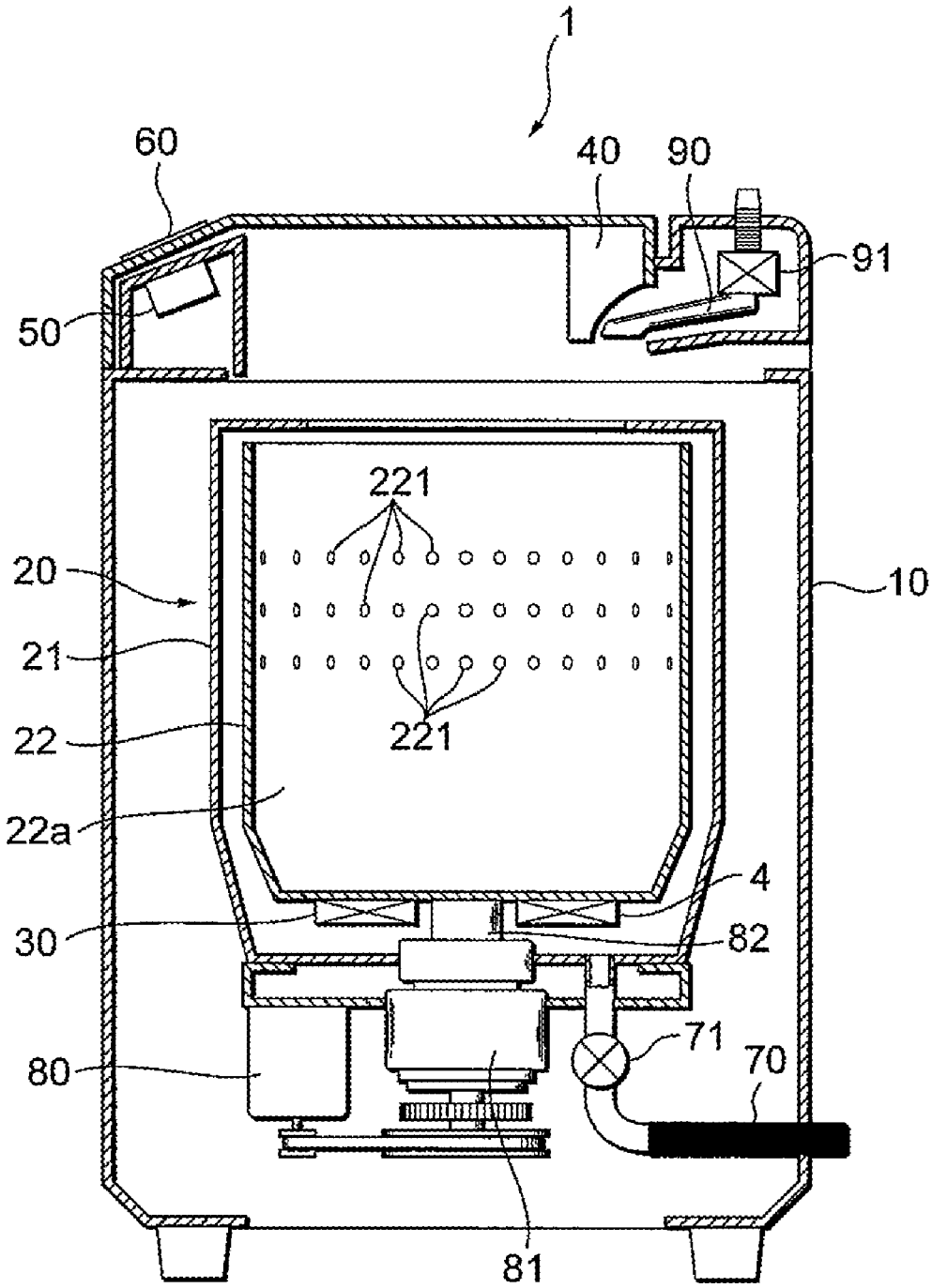
FIG. 1 is a schematic illustration of a cross-sectional view of a cleaning machine adapted for a cleaning method arranged in accordance with the present disclosure.

FIG. 1 is a schematic illustration of a cross-sectional view of a cleaning machine adapted for a cleaning method arranged in accordance with the present disclosure. In FIG. 1, a cleaning machine 1 is shown as including a housing 10. Although the cleaning machine 1 in the present disclosure is explained as a top-loading design, a front-loading design may be employed.

The cleaning machine 1 comprises a container 20, an ultrasonic generator 30, and a cleaning agent dispenser 40, which are disposed in the housing 10. The cleaning machine 1 also includes an electronic control device 50 disposed in the housing 10 and a control panel 60 including various switches disposed to be operated by a user. The cleaning machine 1 is powered by a power switch on the control panel 60. The electronic control device 50 controls various electrically-driven devices installed in the cleaning machine 1 so that the cleaning machine 1 can properly work.

The container 20 is configured so that one or more articles of clothing to be washed or cleaned can be placed therein. The article may be wetted with a liquid containing microcapsules (i.e., cleaning agent) in the container 20. The microcapsules will be explained in detail later. In an example, the container 20 includes a water-retaining tub 21 and a perforated basket 22 concentrically arranged with and contained within the water-retaining tub 21. The water-retaining tub 21 comprises a drain 70 including a valve 71. In a cleaning process, the valve 71 closes to retain the liquid in the container 20. The perforated basket 22 has a number of through-holes 22*a* for spin-drying in the peripheral wall 22*a* thereof. The perforated basket 22 may include an agitator disposed on an internal surface of the peripheral wall 22*a*. The perforated basket 22 is operatively coupled with a motor 80 via a transmission mechanism 81 and configured to rotate on the shaft 82 of the transmission mechanism 81. In a spin-drying process, the perforated basket 22 is spun with a high speed by the motor 80, while the valve 71 opens.

The ultrasonic generator 30 is configured to generate and apply an ultrasonic wave or a high-frequency wave to the article in the container 20. In an example, the ultrasonic generator 30 is attached to the bottom of the perforated basket 22. The ultrasonic generator 30 may comprise one or more piezoelectric devices. The ultrasonic generator 30 may be driven by the ultrasonic generator drive circuit, under control of the control device 50.

The cleaning agent dispenser 40 is configured to hold a cleaning agent therein. The cleaning agent dispenser 40 may supply the cleaning agent to the container by opening a valve (not shown) under control of the control unit 50. The cleaning agent may be poured into the cleaning agent dispenser 40 from the top of the housing 10 before the cleaning process.

The cleaning machine 1 may comprise a water-supply pipe 90 to supply water to the container 20. The water-supply pipe 90 may include a water valve 91. For example, in a rinsing process, the cleaning machine 1 may supply water to the container 20 by opening the water valve 91. In another example, the cleaning machine 1 may add a certain amount of water in the container 20 when the cleaning agent dispenser 40 supplies the cleaning agent thereto.

Figure 2:
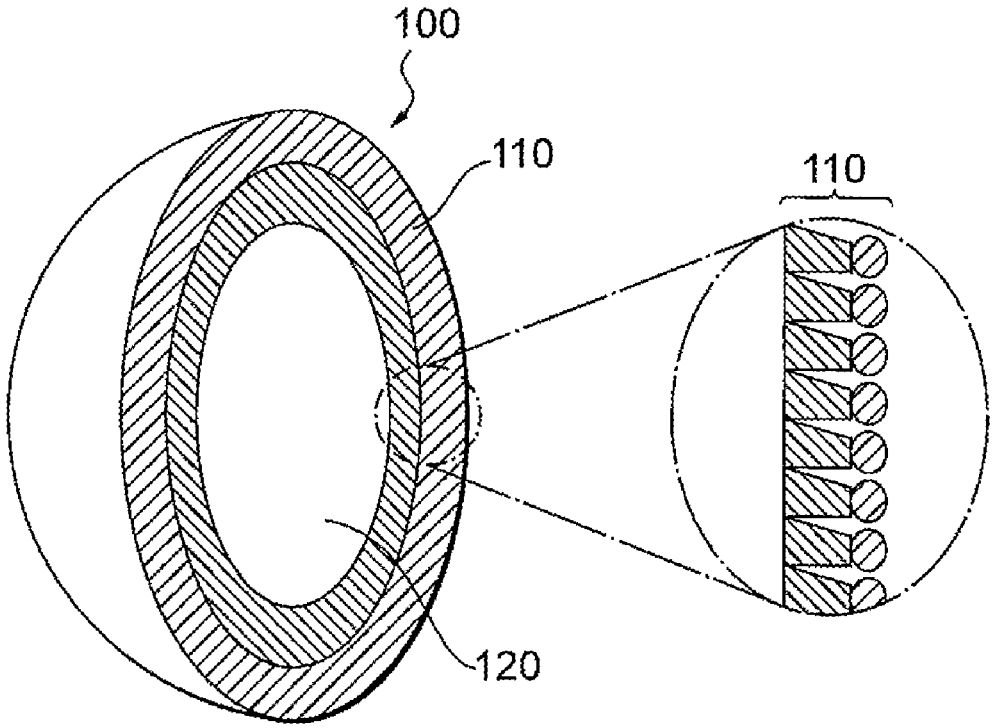
FIG. 2 is a schematic illustration of an example of a microcapsule used in a cleaning method arranged in accordance with the present disclosure.

FIG. 2 is a schematic illustration of an example of a microcapsule used in the cleaning method arranged in accordance with the present disclosure.

Each of microcapsules 100 comprises a shell 110 and a core material 120 encapsulated in the shell 110. A liposome or vesicle may be an example of the microcapsule 100. In an example, the shell 110 may comprise a surfactant, whereas the core material 120 may comprise a gas precursor. In another example, the shell may comprise a protein or a polymer. A mixture of different gas precursors may be used. The diameter of the microcapsule 100 may be between several micrometers and several hundred micrometers, or even smaller, which may be selected so as to be suitable for allowing the microcapsules 100 to penetrate into the structure of the fabric. The microcapsules 100 may be fabricated using various known methods. An example of a method of fabricating a microcapsule is disclosed in International Publication No. WO2005/004781, which refers to U.S. Pat. No. 6,551,576. Specifically, an aqueous suspension or powder (i.e., a bubble coating agent), preferably comprising lipids or albumin, is placed in a vial or container first. A gas phase is then introduced above the aqueous suspension or powder phase in the remaining portion, i.e., the headspace, of the vial. The vial is then shaken during a predetermined period of time, thereby resulting in the formation of liposomes which entrap the gas.

The shell 110 may be formed from, for example, phospholipid. The phospholipid used to form the shell 110 may be in the form of a monolayer or bilayer, and the monolayer or bilayer phospholipid may be used to form a series of concentric monolayers or bilayers. In another example, the shell 110 may be formed from at least one of albumin, gelatin, or alginic acid.

The gas precursor (i.e., core material 120) may be a compound that, at a selected activation or transition temperature, changes its phase from a liquid or solid to a gas. In the present disclosure, ultrasonic energy may be used to obtain the activation temperature. Materials that are vaporized above normal temperature may be selected as the gas precursor. In the present disclosure, the gas precursor may comprise a saturated or unsaturated $C_{3-6}$ hydrocarbon, which may include a fluorine atom. For example, perfluorocarbons are used for the gas precursor. The perfluorocarbons may include, for example, perfluorobutane, perfluorocyclobutane, perfluoromethane, perfluoroethane, perfluoropropane, perfluoropentane, and perfluorohexane. It should be understood that the gas precursors are not limited to the foregoing. As disclosed in the International Publication, various gas precursors may be used to form the core material 120.

A wide variety of materials can be used as gas precursors in the present disclosure. It is only required that the material be capable of undergoing a phase transition to the gas phase when subjected to an appropriate temperature. Suitable gas precursors include, for example, hexafluoroacetone, isopropyl acetylene, allene, tetrafluoroallene, boron trifluoride, isobutane, 1,2-butadiene, 2,3-butadiene, 1,3-butadiene, 1,2,3-trichloro-2-fluoro-1,3-butadiene, 2-methyl-1,3-butadiene, hexafluoro-1,3-butadiene, butadiyne, 1-fluorobutane, 2-methylbutane, decafluorobutane, 1-butene, 2-butene, 2-methyl-1-butene, 3-methyl-1-butene, perfluoro-1-butene, perfluoro-2-butene, 4-phenyl-3-butene-2-one, 2-methyl-1-butene-3-yne, butyl nitrate, 1-butyne, 2-butyne, 2-chloro-1,1,1,4,4,4-hexafluorobutyne, 3-methyl-1-butyne, perfluoro-2-butyne, 2-bromo-butyraldehyde, carbonyl sulfide, crotononitrile, cyclobutane, methylcyclobutane, octafluorocyclobutane, perfluorocyclobutene, 3-chlorocyclopentene, perfluorocyclo-pentane, octafluorocyclopentene, cyclopropane, perfluorocyclopropane, 1,2-dimethyl-cyclopropane, 1,1-dimethylcyclopropane, 1,2-dimethylcyclopropane, ethylcyclopropane, methylcyclopropane, diacetylene, 3-ethyl-3-methyl diaziridine, 1,1,1-trifluorodiazoethane, dimethyl amine, hexafluorodimethylamine, dimethylethylamine, bis(dimethylphosphine)-amine, perfluorohexane, perfluoroheptane, perfluorooctane, 2,3-dimethyl-2-norbornane, perfluorodimethylamine, dimethyloxonium chloride, 1,3-dioxolane-2-one, 4-methyl-1,1,1,2-tetrafluoroethane, 1,1,1-trifluoroethane, 1,1,2,2-tetrafluoroethane, 1,1,2-trichloro-1,2,2-trifluoroethane, 1,1-dichloroethane, 1,1-dichloro-1,2,2,2-tetrafluoroethane, 1,2-difluoroethane, 1-chloro-1,1,2,2,2-pentafluoroethane, 2-chloro-1,1-difluoroethane, 1,1-dichloro-2-fluoroethane, 1-chloro-1,1,2,2-tetrafluoroethane, 2-chloro-1,1-difluoroethane, chloroethane, chloropentafluoroethane, dichlorotrifluoroethane, fluoroethane, perfluoroethane, nitropentafluoroethane, nitrosopentafluoroethane, perfluoroethylamine, ethyl vinyl ether, 1,1-dichloroethane, 1,1-dichloro-1,2-difluoroethane, 1,2-difluoroethane, methane, trifluoromethanesulfonylchloride, trifluoromethanesulfonylfluoride, bromodifluoronitrosomethane, bromofluoromethane, bromochlorofluoromethane, bromotrifluoromethane, chlorodifluoronitromethane, chlorodinitromethane, chlorofluoromethane, chlorotrifluoromethane, chlorodifluoromethane, dibromodifluoromethane, dichlorodifluoromethane, dichlorofluoromethane, difluoromethane, difluoroiodomethane, disilanomethane, fluoromethane, iodomethane, iodotrifluoromethane, nitrotrifluoromethane, nitrosotrifluoromethane, tetrafluoromethane, trichlorofluoromethane, trifluoromethane, 2-methylbutane, methyl ether, methyl isopropyl ether, methyllactate, methylnitrite, methylsulfide, methyl vinyl ether, neopentane, nitrous oxide, 1,2,3-nonadecane-tricarboxylic acid 2-hydroxytrimethyl ester, 1-nonene-3-yne, 1,4-pentadiene, n-pentane, perfluoropentane, 4-amino-4-methylpentan-2-one, 1-pentene, 2-pentene (cis and trans), 3-bromopent-1-ene, perfluoropent-1-ene, tetrachlorophthalic acid, 2,3,6-trimethyl-piperidine, propane, 1,1,1,2,2,3-hexafluoropropane, 1,2-epoxypropane, 2,2-difluoro-propane, 2-aminopropane, 2-chloropropane, heptafluoro-1-nitropropane, heptafluoro-1-nitrosopropane, perfluoropropane, propene, hexafluoropropane, 1,1,1,2,3,3-hexafluoro-2,3-dichloropropane, 1-chloropropane, chloropropane-(trans), 2-chloropropane, 3-fluoropropane, propyne, 3,3,3-trifluoropropyne, 3-fluorostyrene, sulfur (di)-decafluoride ($S_2F_{10}$), 2,4-diaminotoluene, trifluoroacetonitrile, trifluoromethyl peroxide, trifluoromethyl sulfide, tungsten hexafluoride, vinyl acetylene, vinyl ether and xenon.

The phase of the core material 120 encapsulated in the shell 110, when exposed to the ultrasonic wave, changes to a gas phase due to external energy, i.e., the ultrasonic energy, thereby causing the core material 120 to rapidly swell and burst or explode, allowing the core material 120 to escape the shell 110. The explosion energy may contribute to the removal of dirt and stains from the fabric. It should be understood that the explosion energy of the microcapsules 100 is relatively smaller than the ultrasonic cavitation energy in the ultrasonic standing wave field which may cause the ultrasonic erosion.

The microcapsules 100 may in part constitute a cleaning agent. The cleaning agent may be an aqueous solution with the microcapsules 100 dispersed therein. In an example, the cleaning agent may contain a known detergent as a surfactant, which may include auxiliaries, such as enzymes or zeolites. Dirt and stains and fabric may have a strong tendency to become a negative potential in alkaline environments. Thus, the cleaning agent may contain a cationic surfactant. However, it should be understood that other types of surfactants, such as an anion surfactant, a nonionic surfactant, and a zwitterionic detergent may be used.

Figure 3:
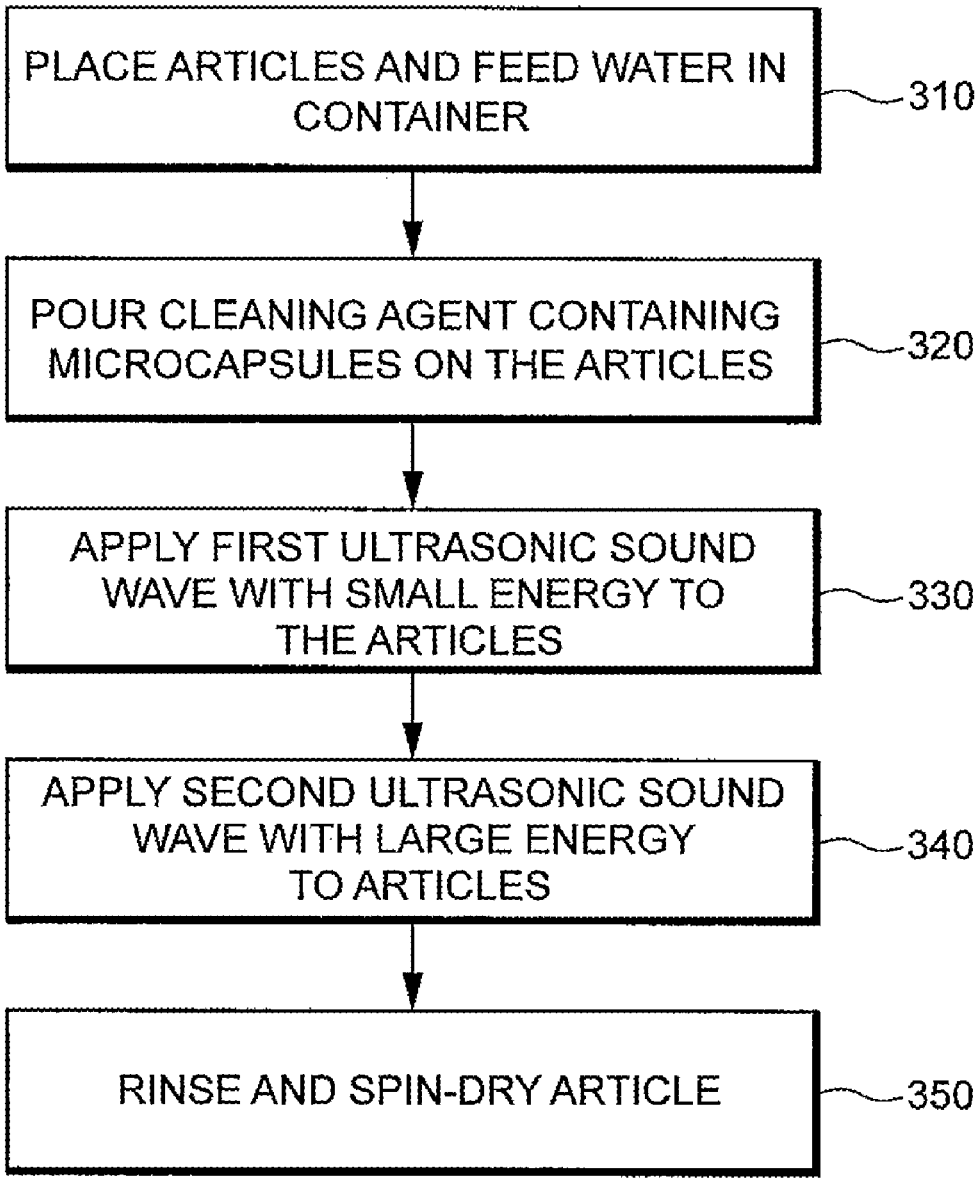
FIG. 3 is a flowchart explaining an example of a cleaning method arranged in accordance with the present disclosure.

FIG. 3 is a flowchart explaining an example of the cleaning method arranged in accordance with the present disclosure. The exemplary method may be performed by the cleaning machine 1 previously described with reference to FIG. 1, or other similarly arranged cleaning machines.

Referring to FIG. 3, the articles, such as clothing and linens, are placed in the container 20 and a relatively-small amount of water is fed from the water-supply pipe 90 in the container 20 so that the articles can be wetted or soaked (block 310). It should be understood that the water as much as submerging the articles is unnecessary, so that the ultrasonic cavitation will not occur. The cleaning agent containing the microcapsules 100 is poured or sprinkled from the cleaning agent dispenser 40 on the articles in the container 20 (block 320). The amount of the cleaning agent may be determined to a large extent, depending on the amount and the degree of contamination of the articles.

An ultrasonic wave with relatively-lower energy is applied to the microcapsules in the cleaning agent in the container 20 by the ultrasonic generator 30 under control of the control device 50 to cause vibrations (block 330). The energy of the ultrasonic wave may be selected so as not to cause the microcapsules to explode or burst. An example of the energy of the ultrasonic wave may be less than about 0.5 w/cm$^2$. The small vibrations may facilitate absorption of the cleaning agent, and accordingly penetration of the cleaning agent, into the articles. Instead of, or in addition to, the ultrasonic vibrations, the perforated basket 22 of the container 20 may be driven under control of the control unit 50 to reciprocally rotate so that the articles as well as the cleaning agent are agitated.

Subsequently, an ultrasonic wave with relatively-higher energy, but not as high as it causes the ultrasonic cavitation, is applied to the microcapsules 100, which have penetrated into the articles, for a predetermined period of time under control of the control device 50 to cause explosion of the microcapsules 100 (block 340). An example of the energy of the ultrasonic wave may be greater than about 0.5 w/cm$^2$ and about 20 w/cm$^2$ or less. Specific examples of energies of the ultrasonic wave are about 0.5 w/cm$^2$, about 1 w/cm$^2$, about 2 w/cm$^2$, about 3 w/cm$^2$, about 4 w/cm$^2$, about 5 w/cm$^2$, about 6 w/cm$^2$, about 7 w/cm$^2$, about 8 w/cm$^2$, about 9 w/cm$^2$, about 10 w/cm$^2$, about 12 w/cm$^2$, about 14 w/cm$^2$, about 16 w/cm$^2$, about 18 w/cm$^2$, about 20 w/cm$^2$, and ranges between any two of these values. The dirt and stains on the fabric of the articles may be subjected to the explosion of the microcapsules 100, and thus removed therefrom. In another example, the higher energy ultrasonic wave may be applied periodically or intermittently under control of the control device 50. Further, during the process in which the higher energy ultrasonic wave is applied, the articles may be agitated by reciprocal rotation of the perforated basket 22.

After applying the two modes of the ultrasonic waves, the articles are rinsed out with water from the water-supply pipe 90 while being agitated in the water, and then spin-dried by rotating the perforated basket 22 at a high-speed (block 350). The rinsing and spin-drying processes may be repeated.

Figure 4A:
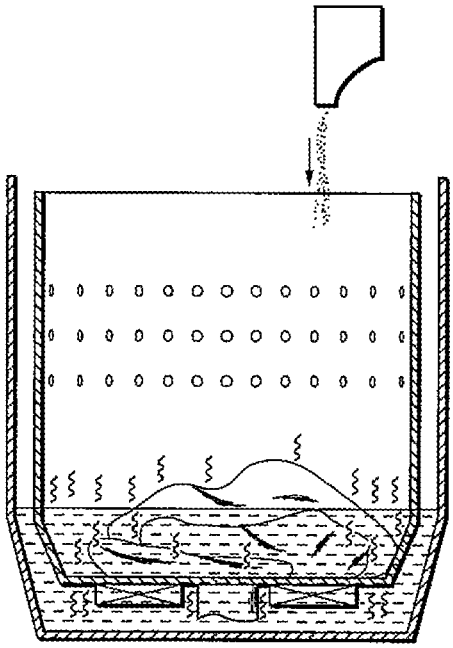
FIGS. 4A and 4B are schematic illustrations explaining applications of the two modes of ultrasonic waves in a cleaning method arranged in accordance with the present disclosure.
Figure 4B:
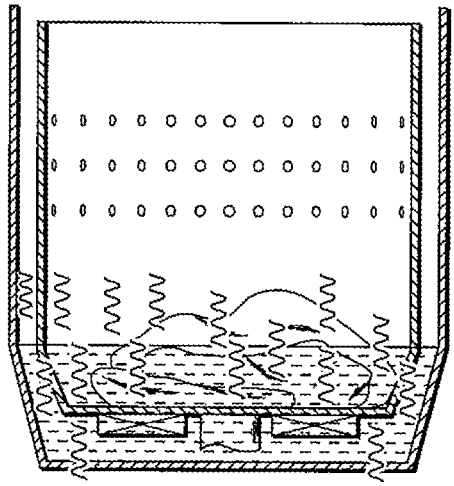

FIGS. 4A and 4B are schematic illustrations explaining applications of the two modes of the ultrasonic waves in the cleaning method arranged in accordance with the present disclosure.

In FIG. 4A, the articles placed in the container 20 is wetted with the cleaning agent containing the microcapsules 100. The cleaning agent may be diluted with water, if necessary. In this situation, the lower energy ultrasonic wave is applied to the microcapsules 100 to cause small vibrations. By way of this, the microcapsules 100 may penetrate into the structure of the fabric of the articles to which dirt and stains may adhere.

After applying the lower energy ultrasonic wave, the higher energy ultrasonic wave is applied to the microcapsules 100 as shown in FIG. 4B to cause the microcapsules 100 to swell and expand.

FIGS. 5A-5D are schematic illustrations explaining cleaning action in the cleaning method arranged in accordance with the present disclosure.

Figure 5A:
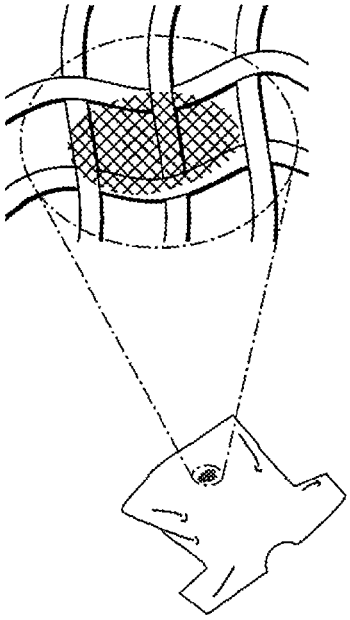
FIGS. 5A-5D are schematic illustrations explaining cleaning action in a cleaning method arranged in accordance with the present disclosure.
Figure 5B:
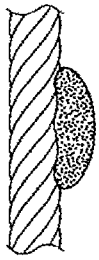

For example, assume that a tough stain adheres to a shirt as shown in FIG. 5A. Such a tough stain may be, for example, an oil stain or a mud stain. When observed by a microscope, such a stain penetrates deep into the structure of fibers constituting the shirt and adheres to each of the fibers as shown in FIG. 5B.

Figure 5C:
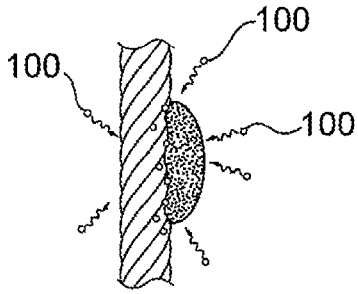

When the cleaning agent is applied to the fibers, it penetrates into the fibers to some extent due to capillary action. In the present disclosure, a low-energy ultrasonic wave is applied, thereby allowing the microcapsules 100 to penetrate deep into the structure of the fibers thoroughly as shown in FIG. 5C.

Figure 5D:
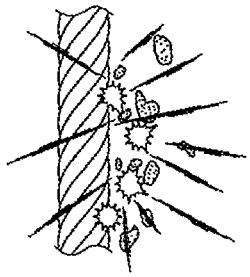

Next, the higher energy ultrasonic wave is applied to cause the microcapsules 100 to swell and explode or rupture as shown in FIG. 5D, releasing gas from the microcapsules. The energy of explosion of the microcapsules acts on the stain and stimulates the removal of the stain therefrom. The gas produced from the explosion of the microcapsule is lifted up together with the removed stain. In addition, the surfactant contained in the cleaning agent contributes to the dispersion of the stain in the aqueous solution. Accordingly, the stain can be easily removed by rinsing.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A cleaning method using ultrasonic waves, the method comprising:

wetting an article to be cleaned with a liquid containing microcapsules, each of the microcapsules encapsulating a gas precursor; and applying a first ultrasonic wave with first energy to the microcapsules such that the first energy of the first ultrasonic wave causes the microcapsules to expand and burst.

2. The cleaning method according to claim 1, wherein the first energy of the first ultrasonic wave is 0.5 w/cm$^2$ or more.

3. The cleaning method according to claim 1, wherein wetting the article with the liquid includes impregnating the article with the microcapsules.

4. The cleaning method according to claim 3, wherein impregnating the article with the microcapsules includes applying micro vibrations to the article.

5. The cleaning method according to claim 4, wherein applying micro vibrations includes applying a second ultrasonic wave with a second energy that is lower than the first energy of the first ultrasonic wave.

6. The cleaning method according to claim 5, wherein the second energy of the second ultrasonic wave is less than 0.5 w/cm$^2$.

7. The cleaning method according to claim 1, further comprising rinsing the article after applying the first ultrasonic wave.

8. The cleaning method according to claim 1, wherein the liquid contains a surfactant.

9. The cleaning method according to claim 1, wherein the liquid comprises a cationic surfactant.

10. The cleaning method according to claim 1, wherein a shell of each of the microcapsules comprises one or more of a surfactant, a protein, or a polymer.

11. The cleaning method according to claim 10, wherein the shell comprises one or more of phospholipid, albumin, gelatin, or alginic acid.

12. The cleaning method according to claim 1, wherein the gas precursor comprises a substance that gasifies above normal temperature.

13. The cleaning method according to claim 1, wherein the gas precursor comprises a saturated $C_{3-6}$ hydrocarbon, unsaturated $C_{3-6}$ hydrocarbon, fluorinated saturated $C_{3-6}$ hydrocarbon, or fluorinated unsaturated $C_{3-6}$ hydrocarbon.

14. The cleaning method according to claim 1, wherein the gas precursor is at least one selected from the group consisting of fluorocarbon, perfluorocarbon, isobutane, butadiene, allene, and isopropylacetylene.

15. A cleaning system comprising:

a container configured to receive an article to be cleaned and a cleaning agent containing microcapsules, wherein the microcapsules are configured to expand and burst when an external energy is applied thereto;

an ultrasonic generator configured to provide an ultrasonic wave to the interior of the container; and a control device configured to select one or more energy levels of the ultrasonic wave.

16. The cleaning system according to claim 15, further comprising a cleaning agent dispenser configured to provide the cleaning agent to the container.

17. The cleaning system according to claim 15, wherein each of the microcapsules encapsulates a gas precursor.

18. The cleaning system according to claim 15, wherein the ultrasonic generator is attached to a bottom of the container.

19. The cleaning system according to claim 15, wherein the ultrasonic generator is configured to provide ultrasonic waves having at least first energy and second energy, wherein the first energy and the second energy are different.

20. The cleaning system according to claim 16, wherein the control device is configured to select first energy of a first ultrasonic wave so as to cause the microcapsules to expand and burst.

21. The cleaning system according to claim 20, wherein the control device performs control such that the ultrasonic generator provides the first ultrasonic wave periodically or intermittently.

22. The cleaning system according to claim 20, wherein the control device is configured to select second energy of a second ultrasonic wave so as to be sufficient to apply micro vibrations to the article.

23. The cleaning system according to claim 22, wherein the second energy of the second ultrasonic wave is lower than the first energy of the first ultrasonic wave.

* * * * *

UNITED STATES PATENT AND TRADEMARK OFFICE

CERTIFICATE OF CORRECTION

PATENT NO. : 8,048,232 B1
APPLICATION NO. : 13/063675
DATED : November 1, 2011
INVENTOR(S) : Kusuura It is certified that error appears in the above-identified patent and that said Letters Patent is hereby corrected as shown below:

In Column 1, Lines 6-7, delete "PCT/W2010/070247," and insert -- PCT/JP2010/070247, --, therefor.

In Column 2, Line 57, delete "unit 50." and insert -- device 50. --, therefor.

In Column 5, Line 31, delete "unit 50" and insert -- device 50 --, therefor.

Signed and Sealed this
Twenty-fourth Day of April, 2012

David J. Kappos

David J. Kappos
*Director of the United States Patent and Trademark Office*